US006464933B1

(12) United States Patent
Popoola et al.

(10) Patent No.: US 6,464,933 B1
(45) Date of Patent: Oct. 15, 2002

(54) FORMING METAL FOAM STRUCTURES

(75) Inventors: Oludele Olusegun Popoola, Novi, MI (US); Ray Jahn, Ann Arbor, MI (US); Robert Corbly McCune, Southfield, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/606,457

(22) Filed: Jun. 29, 2000

(51) Int. Cl.[7] ..... B22F 7/00; B05D 5/00; B05D 1/02

(52) U.S. Cl. ..... 419/2; 419/9; 427/247; 427/427; 427/455

(58) Field of Search ..... 419/2, 9; 427/247, 427/427, 455

(56) References Cited

U.S. PATENT DOCUMENTS

| | | | | |
|---|---|---|---|---|
| 3,723,165 A | * | 3/1973 | Longo et al. | |
| 3,940,262 A | | 2/1976 | Niebyiski et al. | |
| 4,060,433 A | | 11/1977 | Chunat et al. | |
| 4,783,341 A | * | 11/1988 | Packer et al. | 427/8 |
| 4,784,159 A | * | 11/1988 | Szilagyi | 128/784 |
| 5,151,246 A | | 9/1992 | Baumeister et al. | |
| 5,281,251 A | | 1/1994 | Kenny et al. | |
| 5,302,414 A | | 4/1994 | Aikhimov et al. | |
| 5,622,542 A | | 4/1997 | Thomas et al. | |
| 6,254,938 B1 | * | 7/2001 | Pranevicius et al. | 427/453 |
| 6,408,928 B1 | * | 6/2002 | Heinrich et al. | 164/46 |

FOREIGN PATENT DOCUMENTS

| | | | |
|---|---|---|---|
| DE | 19501659 C1 | * | 5/1996 |
| EP | 0483184 B1 | | 5/1992 |
| WO | WO 8905870 | | 6/1989 |
| WO | WO 9617716 | | 6/1996 |

OTHER PUBLICATIONS

H. Eifert, C. Yu, J. Banhart, J. Baumeister, W. Seeliger, "Weight Savings by Aluminum Metal Forms; Production, Properties and Applications" 1999, SAE Publication 1999–01–0887.

D.L. Gilmore, R.C. Dykhuizen, R.A. Neiser, T.J. Roemer, M.F. Smith, "Particle Velocity and Deposition Efficiency in the Cold Spray Process" Dec. 1999, vol. 8, Journal of Thermal Spray Technology.

R.C. Dykhuizen, M.F. Smith, "Gas Dynamic Principles of Cold Spray" 1998, Journal of Thermal Spray Technology.

* cited by examiner

*Primary Examiner*—Ngoclan Mai
(74) *Attorney, Agent, or Firm*—Damian Porcari

(57) ABSTRACT

A method of fabricating a foamed metal structure using a powder supply of metal particles, comprising: (a) introducing the powder supply along with foaming agent particles into a propellant gas to form a gas/particle mixture stream; (b) projecting the mixture stream at a critical velocity of at least sonic velocity onto a metallic substrate to create a deposit of pressure-welded metal particles containing the admixed foaming agent; and (c) subjecting at least the coating of the substrate to a thermal excursion effective to activate expansion of the foaming agent while softening the metal particles for plastic deformation under the influence of the expanding gases.

11 Claims, 3 Drawing Sheets

FORMING METAL FOAM STRUCTURES

BACKGROUND OF THE INVENTION

1. Technical Field

This invention relates to the technology of making lightweight metal cellular structures and particularly to the use of cold-gas spraying techniques for achieving such metallic cellular structures.

2. Discussion of the Prior Art

Foamed metals have been heretofore made by essentially adding a gas-evolving compound to molten metal and thereafter heating the mixture to decompose the compound causing the gas evolved to expand and foam the molten metal (see U.S. Pat. Nos. 3,940,262; 5,281,251; 5,622,542). To avoid adding the gas-evolving compound to a molten body of metal, solid particles of the metal, mixed with a gas-evolving compound, can be hot pressed or compacted and then subsequently heated near the melting temperature of the metal, or into the solidus-liquidus range of the metal, to create foaming for a cellular structure (see U.S. Pat. No. 5,151,246). Casting molten metal around granules which are then leached out leaving a porous structure is another method of providing metals with cellular structures.

None of the above techniques are compatible with providing a preformed substrate with a foamed metal coating. Among the techniques used to obtain thick coatings on metal members, are thermal-spray depositions, such as plasma jet or electric-arc metal spraying which presents several drawbacks: unfavorable high thermal and dynamic effects on the substrate; unfavorable changing of the physical properties of the coating during spraying; unfavorable phase transformation of the deposited particles; overheating of the substrate; and erosion or jamming of the spraying equipment.

What is needed is a relatively low temperature spraying technique that achieves compacting of the sprayed metal particles and yet has a composition that promotes foaming to achieve a cellular deposit. "Cold-gas" dynamic spraying of metals was initiated in Russia relatively recently as evidenced by their U.S. Pat. No. 5,302,414. However, the disclosure of such Patent did not teach how to achieve a foamed structure nor did it teach suitable parameters to obtain metal particle welding commensurate with the need for metal foaming.

SUMMARY OF THE INVENTION

The invention herein creates a cellular, venticular or foamed metal structure by first depositing a coating of cold-compacted metal particles, containing a foaming agent, onto a suitable substrate as a result of at least sonic-velocity projection of such particles, and, secondly, thermally treating the coating to gasify the foaming agent and thermally transform the welded metal particles to a plastic-like condition, such as a result of the temperature being slightly above the softening temperature for the metal or above the eutectic temperature of the metal if it is such an alloy.

In a more definitive aspect, the invention is a method of fabricating a foamed metal structure using a supply of metal particles, comprising: (a) introducing a supply of powder metal particles and foaming agent particles into a propellant gas to form a gas/particle mixture; (b) projecting the mixture at or above a critical velocity of at least sonic velocity onto a metallic substrate to create a deposit of pressure-compacted metal particles containing the admixed foaming agent; and (c) subjecting at least the coating on said substrate to a thermal excursion effective to activate expansion of the foaming agent while softening the metal particles for plastic deformation under the influence of the expanding gases.

DETAILED DESCRIPTION AND BEST MODE

Figure 1:
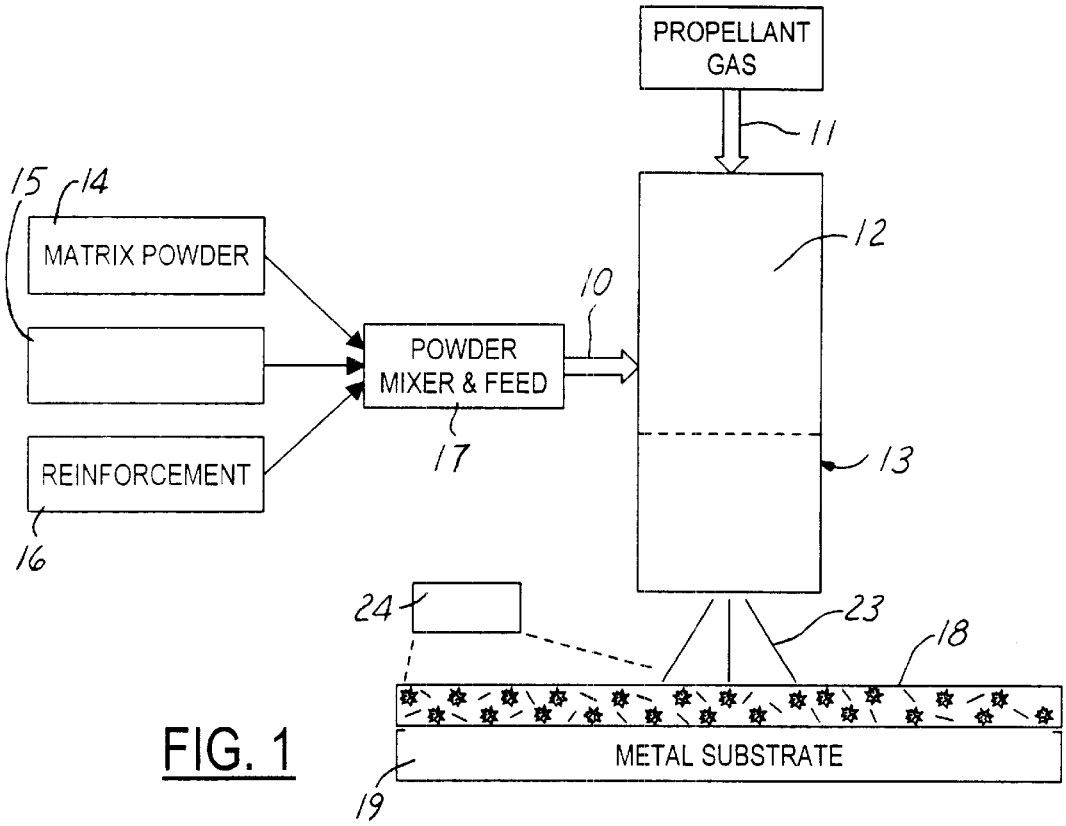
FIG. 1 is a schematic flow diagram of the inventive method which achieves a projected deposit of pressure-compacted particles containing an expansion agent.
Figure 2:
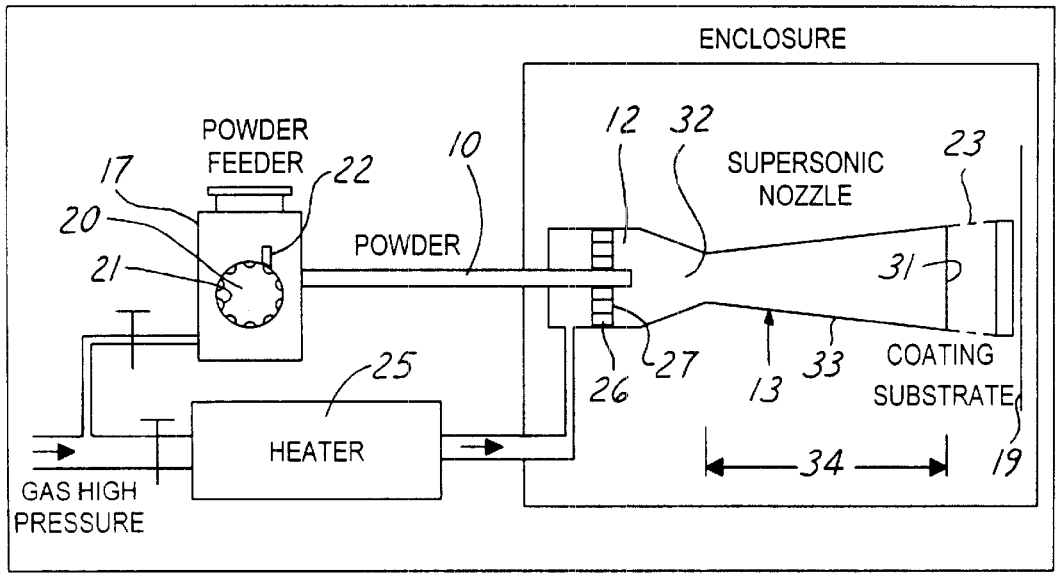
FIG. 2 is an elementary diagram illustrating spraying apparatus useful in carrying out the mixing and spraying steps of FIG. 1.

As shown in FIG. 1, the method begins by introducing a mixture of solid particles 10 and a carrier or propellant gas 11 to an ante-chamber 12 (entrance) of a supersonic nozzle 13 for projecting the mixture of particles and gas at a critical velocity to achieve a pressure-welded deposit 18. The solid particles 10 may be formed of a combination of solid metal particles 14, solid foaming agent particles 15, and any reinforcement particles 16 (such as Si, SIC, TIC, $SiO_2$, graphite) separately added or incorporated directly in the matrix of the solid metal particles. The solid particles 10 are put into a particle mixer and metering feeder 17 where as shown in FIG. 2, the mixer blends the different particles together for a generally homogeneous mixture 24; the feeder has a cylindrical drum 20 with surface depressions 21 that accept a predetermined quantity of the solid particle mixture 24 for transfer, according to a powder controller 22, to the ante-chamber 12 of the nozzle. The transferred particles are admixed with the propellant gas 11 in a ratio of gas to particles of about 20:1. By changing the percentage of components and/or the temperature of the propellant gas, the velocity of the gas jet 23 and thereby the velocity of the mixture 24, can be varied. It is the velocity of the mixture that is important. The mixture must be projected at or above a critical velocity to attain a pressure compacted or welded deposit. "Critical velocity" has been defined, by practitioners of cold spraying, to be the particle velocity at which all particles impacting the surface will adhere to the surface to form a coating or deposit. In general, the critical velocity will vary with the type of sprayed material, particle size of the material, and substrate condition. To assure attaining the critical velocity for a particular material, it may be advantageous if the propellant gas is heated by a heater 25 to a temperature in the range of 300–600° C., and administered at a pressure of 100–500 psi to the nozzle ante-chamber 12 to more easily attain the mixture critical velocity as a consequence of gas expansion and cooling through the nozzle throat. Such heating may be carried out by use of thin-walled tubes (carrying the gas) in heater 25 (which may be any suitable means such as a radiator or resistively-heated metal elements. It may be desirable to employ a diaphragm 26, having ports 27, in the ante-chamber of nozzle 13 for equalizing the gas velocity there-into.

The substrate 19 can be any structural material that can withstand the pressures and temperatures of the deposition and heat treatment. Preferably, the substrate is comprised of aluminum or steel sheet. The metal particles 29 preferably comprise an aluminum-silicon alloy (containing 6–12 wt. % Si) because of the capability to reduce the softening temperature as a consequence of eutectic alloy formation; however, such metal particles can be selected as any relatively low melting point metal, such as aluminum, aluminum alloys, magnesium, magnesium alloys, zinc or bronze, all of which facilitate the heat treating step. The metal particles desirably have a particle size in the range of 10–40 microns, with no particles under 10 microns. The foaming agent particles are preferably comprised of titanium hydride, but can be other equivalent agents that thermally decompose at relatively low temperatures, such as carbonates, nitrates, or sulfates or any of several organic solids which are volatilized at low temperatures relative to the softening point of the metal being foamed. The carrier or propellant gas is selected to produce the appropriate critical velocity for the material to be deposited and its substrate. In many cases, critical velocities for easily deformed metals such as aluminum and copper can be achieved with air or dry nitrogen. For harder metals, such as iron and steel, critical velocities can only be achieved through the use of either pure helium gas, having a higher sonic velocity than air or nitrogen, or mixtures usually 50% air or nitrogen and 50% helium. Preheating and pressurizing the upstream gas supply increases the gas velocity through the converging-diverging nozzle employed, and in general, this becomes a means to impart higher velocities to the particle stream.

The propellant gas is drawn from a pressurized supply 30 having a pressure of at least 350 psi (preferably 370–400 psi); the propellant gas is preferably heated to a temperature of 300–500 F. by heater 25 to promote higher supersonic velocities. The gas flow rate is desirably in the range of 30–40 grams/second at the outlet edge 31 of the nozzle 13. The nozzle design has a critical throat area 32 followed by a diverging channel 33, with the length 34 of the diverging channel being considerably longer than any cross-sectional dimension 35 of the nozzle at the outlet edge 31. The powder flow rate through the nozzle is advantageously about 0.1–20 grams/second. It is important that the nozzle design, standoff distance, and any entrained particles, by resultant aerodynamic drag forces. In most cases, critical velocities of practical materials will be supersonic for most configurations of propellant gas and nozzle design. Recent data by Gilmore, et al, for example shows the critical velocity for 20 micron diameter copper particles to be about 640 m/sec (D. L. Gilmore, R. C. Dykhuisen, R. A. Neiser, T. J. Roemer and M. F. Smith, Journal of Thermal Spray Technology, Vol 8 [4], pp 576–582, December 1999). Estimates of the critical velocity for aluminum, for example, appear to be above 1000 m/sec.

Figure 3:
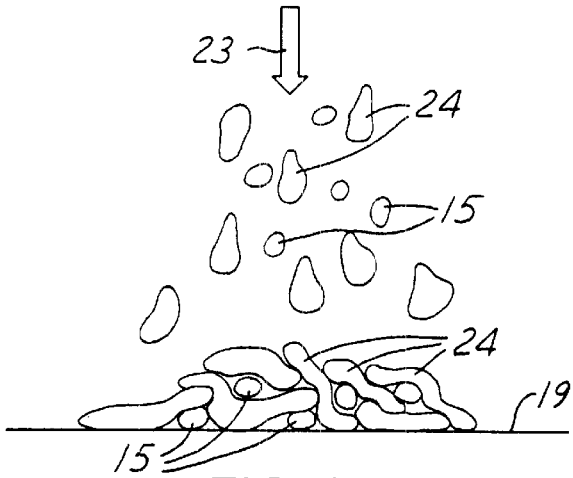
FIG. 3 is an enlarged schematic illustration of metal and foaming agent particles colliding with the substrate to create a pressure-compacted or welded deposit.
Figure 4:
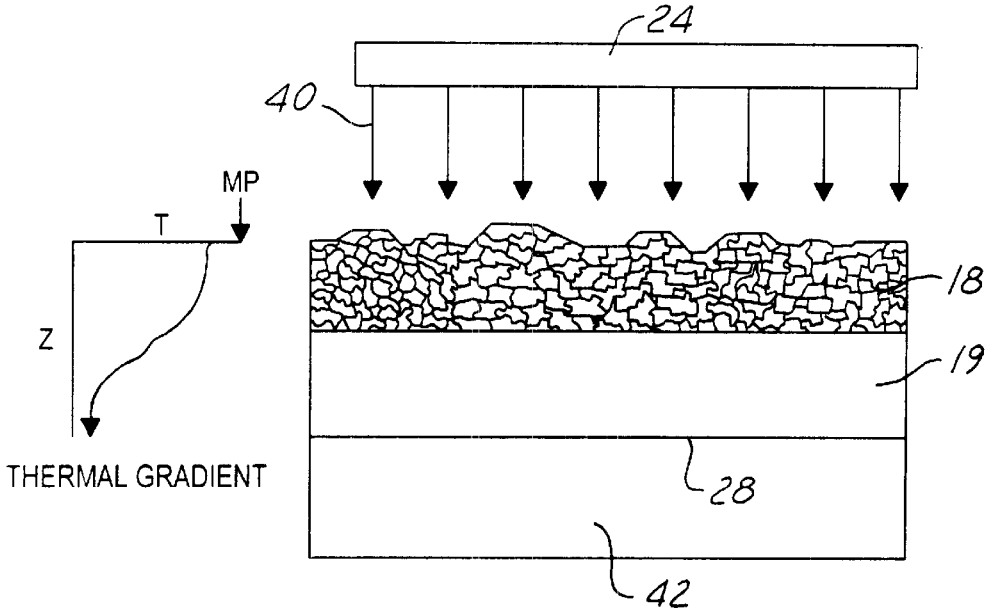
FIG. 4 is a schematic view of the deposit undergoing thermal treatment and additionally showing use of a heat sink.

As a result of the projection at or above critical velocities, the particles form deposit 18 as shown in FIG. 3, wherein the metal particles 24 are plastically deformed against the substrate 19 as well as against each other as they accumulate, trapping the foaming agent there-between in a generally uniform homogeneous. Pressure welding of the metal particles occurs as a result of kinetic pressure of impact and the thermal content of the deposit due to any propellant gas heating and energy dissipation upon physical impact.

Figure 5:
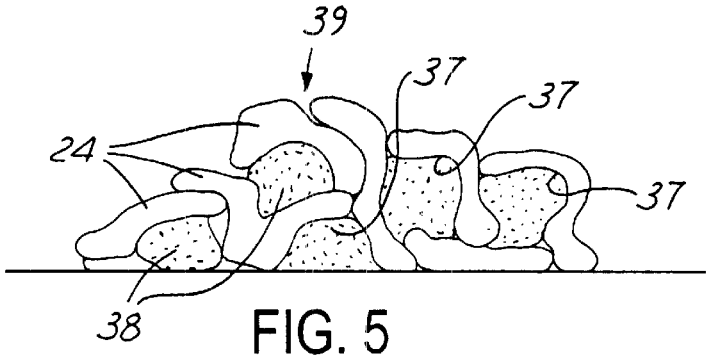
FIG. 5 is a view of the deposit in FIG. 3 after thermal treatment to activate the foaming agent and thereby create the cellular metal structure.
Figure 6:
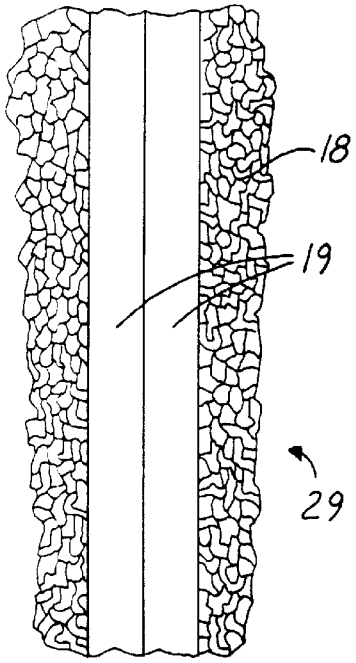
FIGS. 6 & 7 are views of different products resulting from the use of the invention herein.

The bulk deposit or coating must then be subjected to a thermal excursion effective to activate and expand the foaming agent as shown in FIG. 5. The metal particles, having been pressure-welded to each other, create sealed chambers about the co-mingled foaming agent particles 28 so that upon heating of such agent, the evolved gaseous products or bubbles 38, from decomposition, will plastically deform the surrounding metal to create cells 37. Thermal excursion heating, to affect metal foaming, can be carried out by use of radiant, microwave, or induction heating, or equivalent means. The temperature to which the metal particles and foaming agent are heated, should be sufficient to make the metal slightly plastic (be above the eutectic temperature for alloys). For aluminum-silicon, this would be about 577° C. The thermal excursion may be localized to essentially the deposit layer by delivery of the heat in short bursts so that the layer is exposed to higher heat content for liberating the foaming agent gases while the substrate remains at a lower temperature due to heat pulsing above the deposit (see FIG. 6). Induction heating can be used to obtain differential heating which is particularly useful when the metal structure is iron/aluminum, having different frequency responses. Pulsed heat input 40 from the top-side results in a thermal gradient across the foamed metal structure and substrate. Such heat gradient may also be varied by placing a heat sink 42 into contact with the backside 38 of the substrate. Convection furnace heating is not an effective mode because of the lack of control of differential heating between the coating and substrate, while also consuming more energy.

Figure 7:
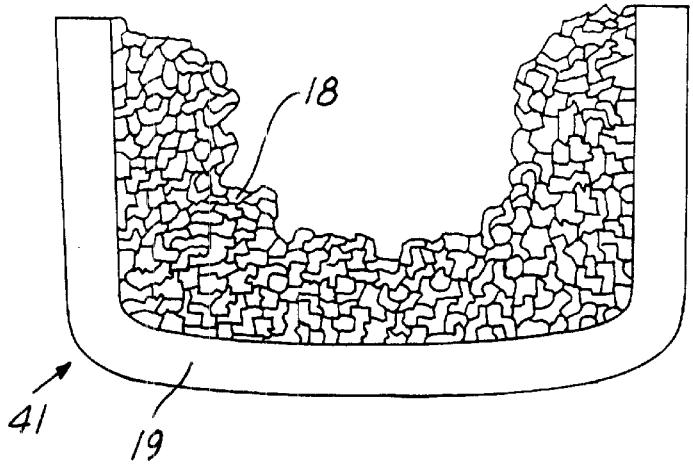
Figure 8:
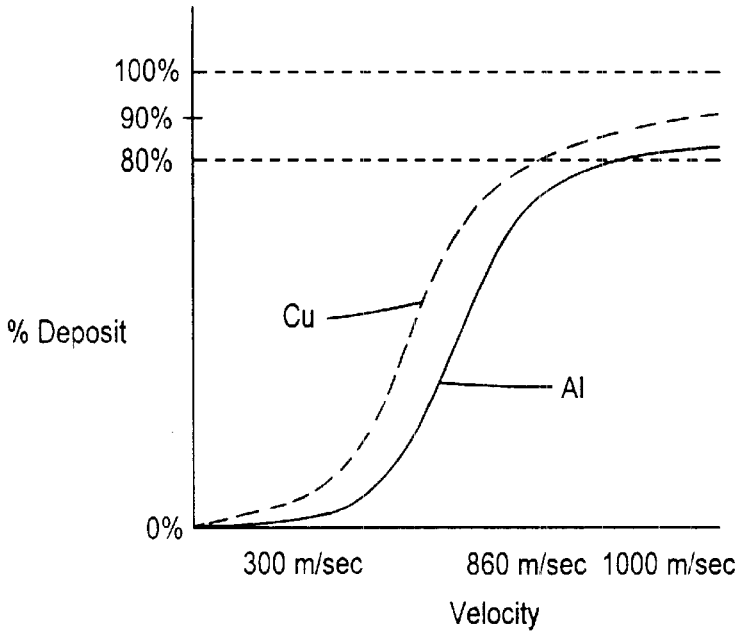
FIG. 8 is a graphical illustration showing the relationship between the percentage of particle deposit as a function of nozzle projection velocity for different metals.

The foamed structure 39 can be formed on a single ply sheet with a foamed metallic layer on one side; the sheets may then be bonded back-to-back to create an assembly as shown in FIG. 7. Such sandwiched configuration provides good improvements in buckling resistance and crush energy for vehicular structures. Advanced shapes can also be formed by cold-spraying the mixture of this invention into pre-shaped articles or channels 41 as shown in FIG. 8. Such articles or channels offer superior strength and crush energy absorption with much lower structural weight. While the best mode for carrying out the invention has been described in detail, those familiar with the art to which this invention relates will recognize various alternative designs and variations for practicing the invention as defined by the following claims.

What is claimed is:

1. A method of fabricating a foamed metal structure using a powder supply of metal particles, comprising:

(a) introducing the supply of metallic powder particles, along with foaming agent particles, into a propellant gas preheated to a temperature in the range of 300–500° F. and pressurized to at least 350 psi, to form a gas/particle mixture;

(b) projecting said mixture at least at a critical particle velocity onto a metallic substrate to create a deposit of pressure-welded metal particles containing said admixed foaming agent; and (c) concurrently or subsequently subjecting at least the coating on said substrate to a thermal excursion effective to activate expansion of said foaming agent while softening the metal particles for plastic deformation under the influence of the expanding gases.

2. The method as in claim 1, in which said critical particle velocity is in the range of 300–1200 m/sec. and is sufficient to achieve at least an 80% particle deposition efficiency.

3. The method as in claim 1, in which said metal particles are selected from the group consisting of aluminum, aluminum alloys, magnesium, magnesium alloys, zinc, bronze, and other low melting point metals of the same class.

4. The method that as in claim 3 in which said foaming agent is selected from the group consisting of titanium hydride, calcium-carbonate, and thermally decomposable carbonates, nitrates, sulfates that evolve decomposition gases.

5. The method as in claim 1, in which said propellant gas is selected from the group consisting of nitrogen, air, and helium, or mixtures thereof.

6. The method as in claim 1, in which said projecting step is carried out by use of a supersonic nozzle presenting a jet cross-sectional profile that is generally a rectangle.

7. The method as in claim 1, in which said metal and foaming particles have a size range of 10–40 microns.

8. The method as in claim 7, in which the flow rate of said metal and foaming particles, as they exit from said nozzle, is in the range of 0.05–17 grams/sec.

9. The method as in claim 1, in which said thermal excursion step is carried out without raising the temperature of said substrate above 70° C.

10. The method as in claim 9 in which said thermal excursion is carried out by impulsing the application of heat energy to localize the heating to the deposited material.

11. A method of fabricating a foamed metal structure using a powder supply of aluminum-silicon metal particles, comprising:

(a) introducing the supply of metallic powder particles, along with foaming agent particles, into a propellant gas to form a gas/particle mixture;

(b) projecting said mixture at least at a critical particle velocity onto a metallic substrate to create a deposit of pressure-welded metal particles containing said admixed foaming agent; and (c) concurrently or subsequently, subjecting at least the coating on said substrate to a thermal excursion at a surface temperature of 577° C., effective to activate expansion of said foaming agent while softening the metal particles for plastic deformation under the influence of the expanding gases.

* * * * *